US005415498A

United States Patent [19]

Seegmiller

[11] Patent Number: 5,415,498

[45] Date of Patent: May 16, 1995

[54] MINE ROOF SUPPORT SYSTEMS AND COMPONENTS

[76] Inventor: Ben L. Seegmiller, 143 S. 400 East, Salt Lake City, Utah 84111

[21] Appl. No.: 80,540

[22] Filed: Jun. 24, 1993

[51] Int. Cl.[6] ..... E21D 20/00; E21D 21/00

[52] U.S. Cl. ..... 405/288; 405/302.1; 405/302.2

[58] Field of Search ..... 405/288, 302.1, 302.2, 405/302.3

[56] References Cited

U.S. PATENT DOCUMENTS

| | | | |
|---|---|---|---|
| 3,107,902 | 10/1963 | Calder | 405/288 X |
| 4,413,928 | 11/1983 | Tucker | 405/288 X |
| 4,666,344 | 5/1987 | Seegmiller | 405/288 X |
| 4,775,266 | 10/1988 | Seegmiller | 405/288 |
| 4,776,729 | 10/1988 | Seegmiller | 405/288 |
| 4,960,348 | 10/1990 | Seegmiller | 405/288 X |
| 5,026,217 | 6/1991 | Seegmiller | 405/288 |

FOREIGN PATENT DOCUMENTS

| | | | |
|---|---|---|---|
| 2845130 | 4/1980 | Germany | 405/302.3 |
| 1125380 | 11/1984 | U.S.S.R. | 405/288 |

*Primary Examiner*—Randolph A. Reese
*Assistant Examiner*—John A. Ricci
*Attorney, Agent, or Firm*—M. Ralph Shaffer

[57] ABSTRACT

Mine roof support systems, components and method, for supporting, whether in active or passive mode, mine roof strata; first and second, mutually spaced series of brackets are supplied for mounting to opposite sides of a mine roof span, and one or more cable assemblies are looped about such brackets and secured to the mine roof strata, such cable assemblies also being provided with take-up means: the invention is suitable and effective for supporting mine roof strata at various, desire mine locations.

12 Claims, 11 Drawing Sheets

MINE ROOF SUPPORT SYSTEMS AND COMPONENTS

FIELD OF INVENTION

This invention relates to mine roof support systems, methods and components thereof, and more particularly, to improved support systems, methods and components, wherein flexibility is offered and can be maintained for tending to preserve the integrity of mine roof strata, this by the employment of the new and useful support systems, including trussing systems and components thereof, and methods to achieve the support function desired; at least some of the foregoing envision and/or incorporate cable type connectors or rigidly connected trussing structures.

BRIEF DESCRIPTION OF PRIOR ART

In the past, many types of mine roof supports and trussing systems have been developed for use in supporting mine roofs through compression loading thereof. The inventor has filed for and has obtained numerous patents in this general area among which are the following (U.S.):

| | | |
|---|---|---|
| 4666344 | 4775266 | 4960348 |
| 4699547 | 4776729 | 5026217 |

No prior art is currently known by the inventor as to the concept of using cables, called "strands," and/or other structure in mine trussing and support systems in the manner as fully disclosed herein, this with brackets which are specially designed for securement to mine roof strata proximate the rib junctures and their intersection with the mine roof. Particularly is this the case in connection with the use, presented in the specification, of cable lengths, and/or serpentine cables or cable components in conjunction with brackets, the cables being utilized so that when they are placed in tension, the tension forces are translated as compression forces to the mine roof strata so as to tend to support the mine roof. Also absent in the prior art, as is understood, is the concept of designing mine roof anchor brackets where the same can accommodate one or more cables and also angular bi-directional securement of stirrups used for connection purposes. Broadly, the support structure, components and methods below fully described, useful for supporting roof structure, whether in an active or passive mode, pre-tensioned or otherwise, is deemed completely new.

BRIEF DESCRIPTION OF PRESENT INVENTION

Accordingly, in the present invention the structure, methods and components described are useful for providing mine roof support, either in an active, pre-tensioned mode, forming in effect a truss or otherwise, or in a passive, cradle or sling mode, which envisions the possible progressive dialation of the mine roof, under its own weight, with the addition of abutment loads from surrounding rock, to produce a tensioning of the subject structure, be the same a sling, cradle, or other structure envisioned herein. The invention is suitable in all underground mine areas, in long-wall mining or otherwise, namely: recovery rooms, start-up rooms, entries, crosscuts, tunnels, drifts, tunnels, and other openings or passages, etc. In one form of the invention, a series of mutually and oppositely spaced brackets are employed, this in conjunction with tie rods and/or, and preferably, elongated cable connectors which in one form of the invention are arranged in serpentine fashion, are looped around brackets uniquely designed therefor, and which are tightened or tensioned by appropriate take-up end fitting connections. The brackets themselves have depending bodies provided with access openings contoured to receive one or more cables that are to be retained, at medial portions of such cables, by such brackets. The brackets themselves are provided with structure for securing the same to mine roof strata, preferably by anchor bolts extending over rib-roof intersections and overlaying the rib portions of a mine opening. The cables employed may be either singular or multiple and, in any event, will incorporate end fittings or end structures suitable for both securement and tensioning or simply take-up purposes. Plural brackets are provided and are designed either to accommodate the looping and/or angular securement and/or angular retention of cable portions, or of providing for stirrup connections to such brackets in a manner such that the stirrups are in mutually angular orientation. The invention, however, broadly defines a mine roof support system which can be made up of cables and/or tie rods, for example, spanning a mine roof section, with mounting securement structure being supplied. The method comprises a series of successive steps, as hereinafter detailed, to accomplish the retention function, whether in active or passive mode.

OBJECTS

Accordingly, a particular object of the present invention is to provide new and improved support systems, components, and methods of installation, as regards mines roofs.

An additional object is to provide a support system, for mines roofs, including cables as permissibly tensioned elongated elements.

An additional object is to provide suitable brackets for accommodating mine roof support structures, wherein such brackets are designed to accommodate angular connection thereto by permissably tensioning structure.

A further object is to provide a new and useful mine roof bracket having a retention opening configured to accommodate one or more cables or cable lengths inserted therein for retention purposes.

A further object of the invention is to provide a mine bracket wherein the same incorporates a pair of horn-like depending body portions, each offering an opening to a respective stirrup or otherwise suitable structure, and this to accommodate connection to the remainder of a trussing system.

DRAWINGS

The features of the present invention may best be understood by reference to the following detailed description, taken in connection with the accompanying drawings, in which:

FIG. 1 is a bottom plan view, looking up, of a mine passageway, looking upwardly toward the roof area and illustrating one type of mine roof support system, wherein brackets are installed proximate the rib-roof junctures of the mine opening and, further, wherein a cable connector, end connections not being shown, is provided and is arranged in serpentine configuration for looping over and general connection to the installed brackets.

Figure 5:
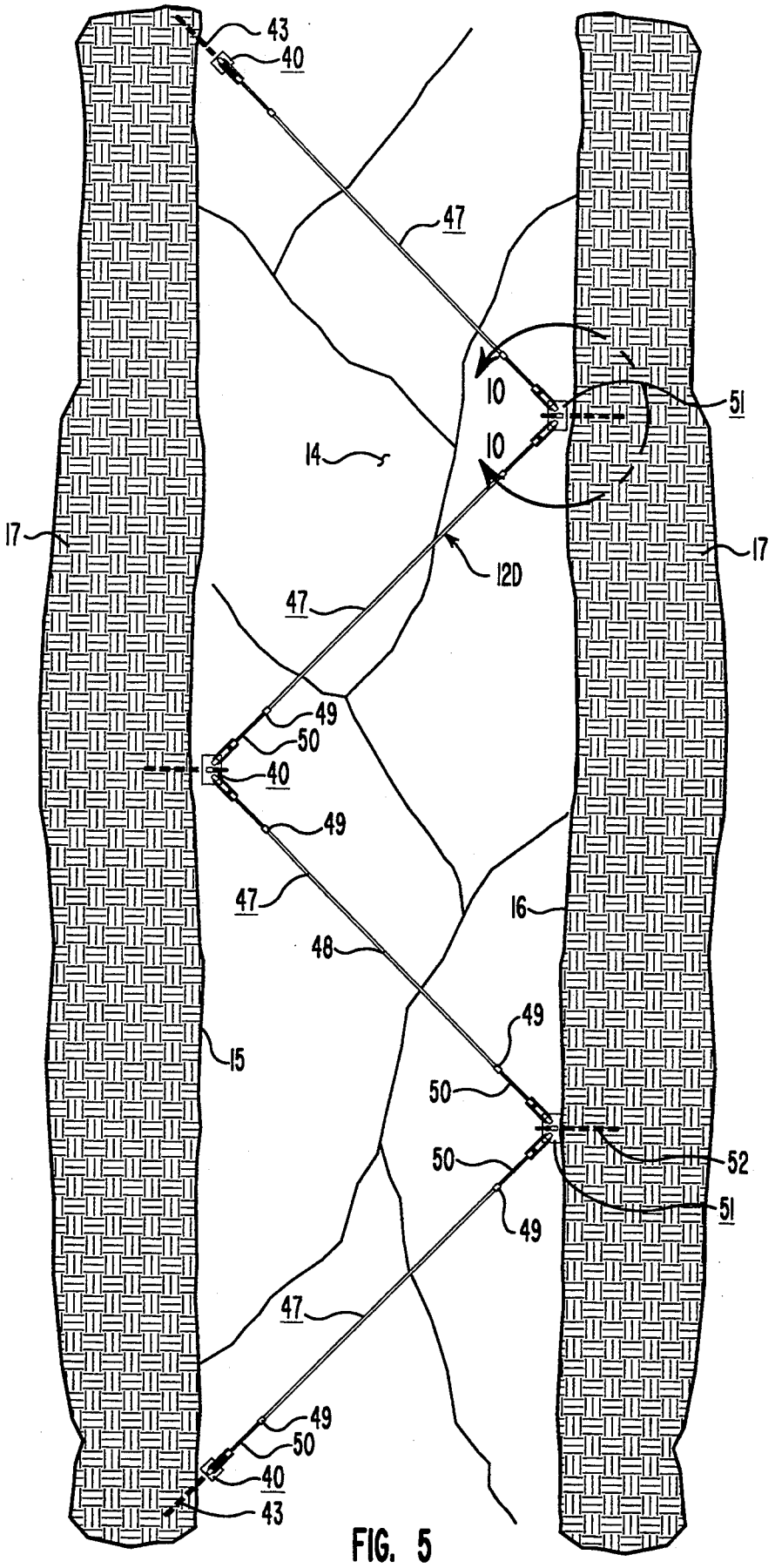

FIG. 5 is a bottom plan, i.e. looking up, of a mine opening, the view being toward the mine roof area, this figure showing an alternate support system wherein a series of alternate brackets are employed for anchoring to the mine roof over the rib area, the brackets being used for bi-angular engagement with elongated support elements, generally cables, tie rods, or elongated connector bars, the important point being that the stirrups are designed to accomplish retention along angularly spaced directions.

Figure 6:
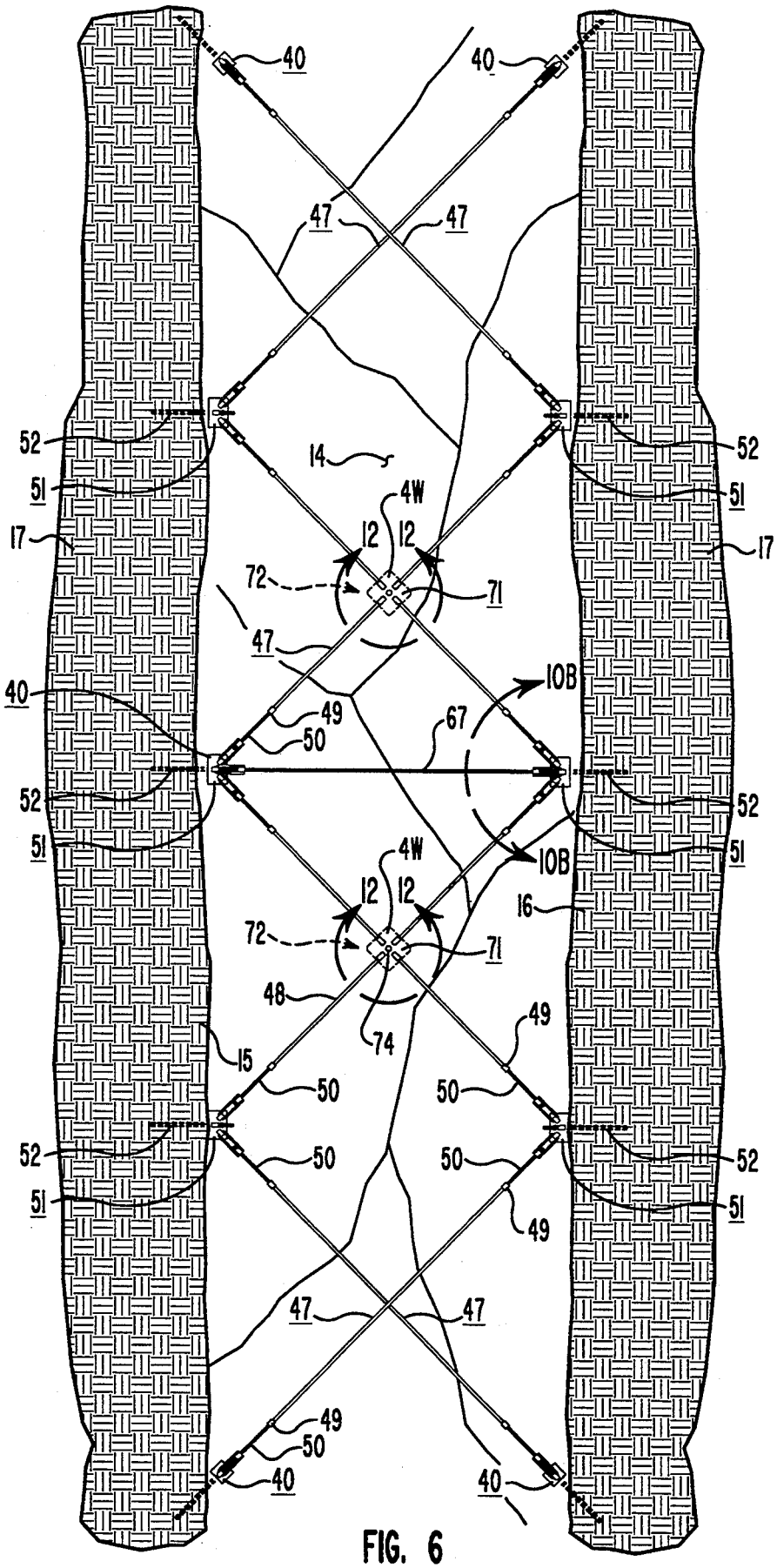

FIG. 6 is similar to FIG. 5, but illustrates an additional elongated mine roof support system being incorporated with the first, relative to FIG. 5.

Figure 1:
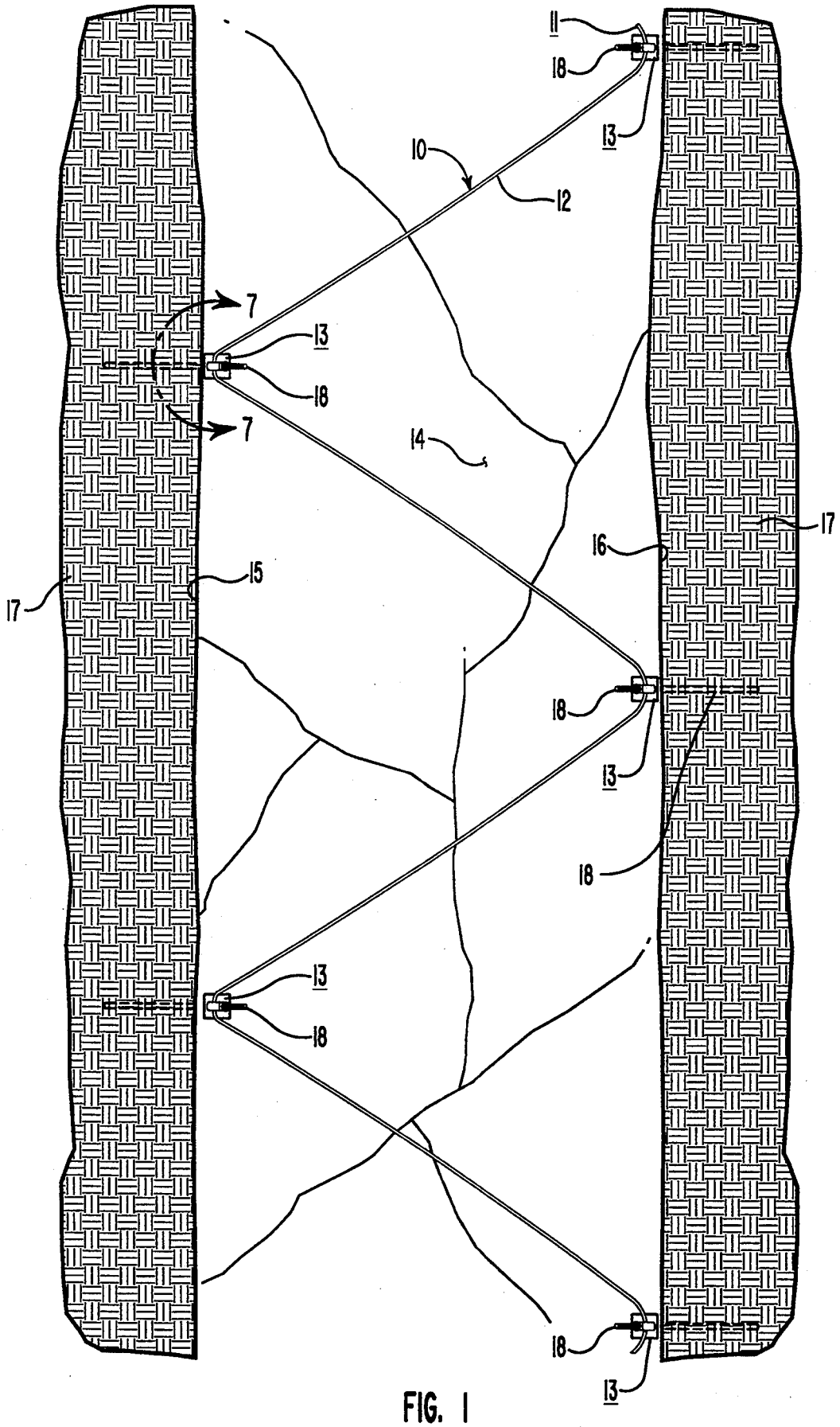
Figure 7:
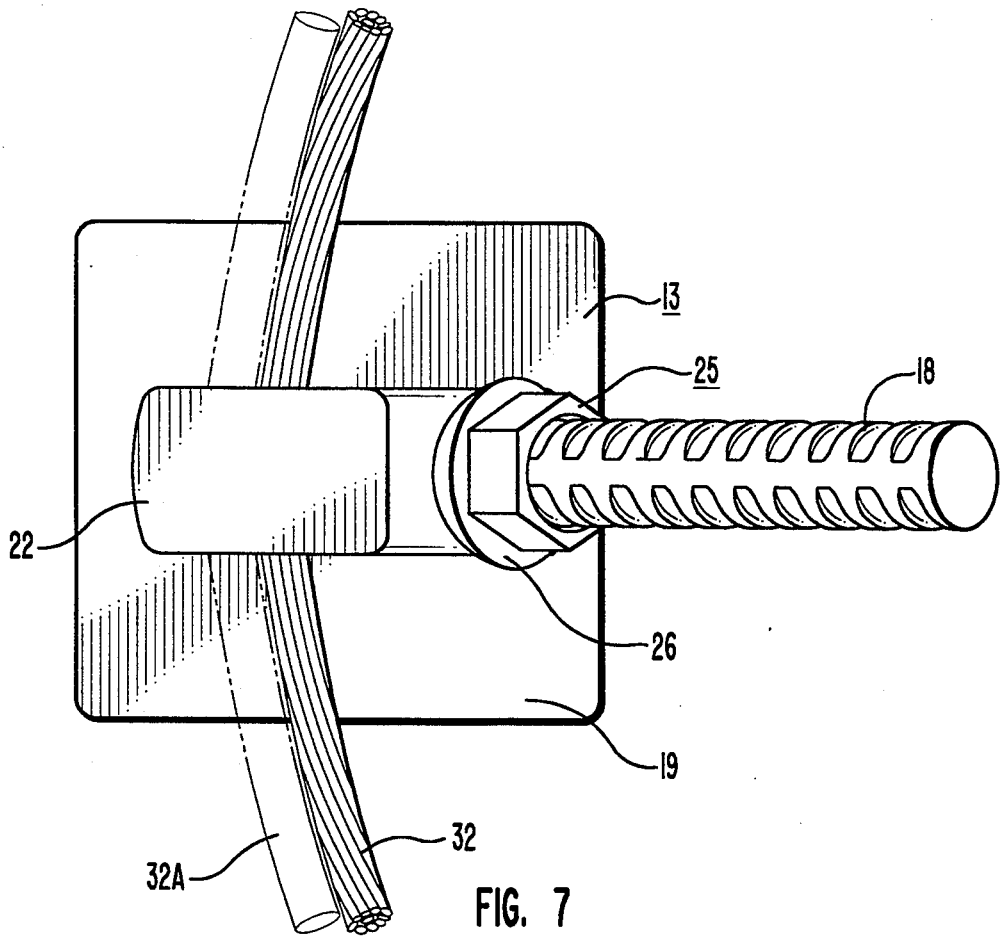

FIG. 7 is an enlarged bottom plan of a representative particular bracket utilized in the invention, in FIG. 1 for example, taken along the arcuate line 7—7 in FIG. 1.

Figure 8:
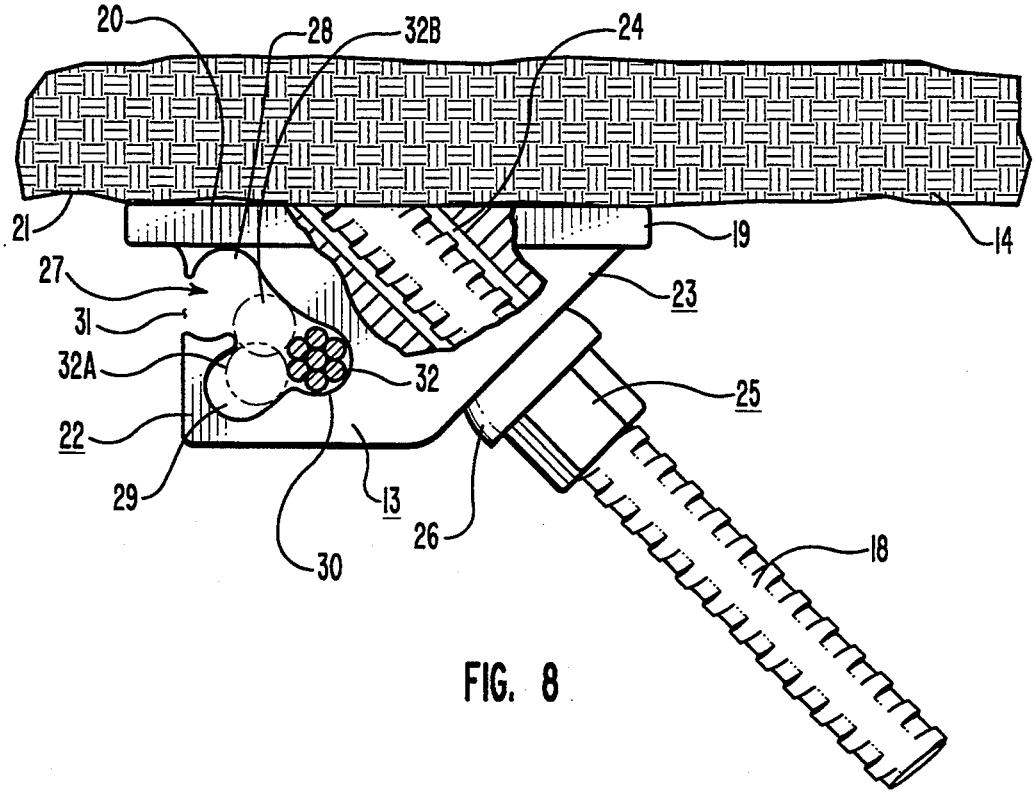

FIG. 8 is a side elevation of the structure of FIG. 7, partially broken away for convenience of illustration, and illustrates a side view of such bracket with its composite opening to provide access for one or more cables.

Figure 3:
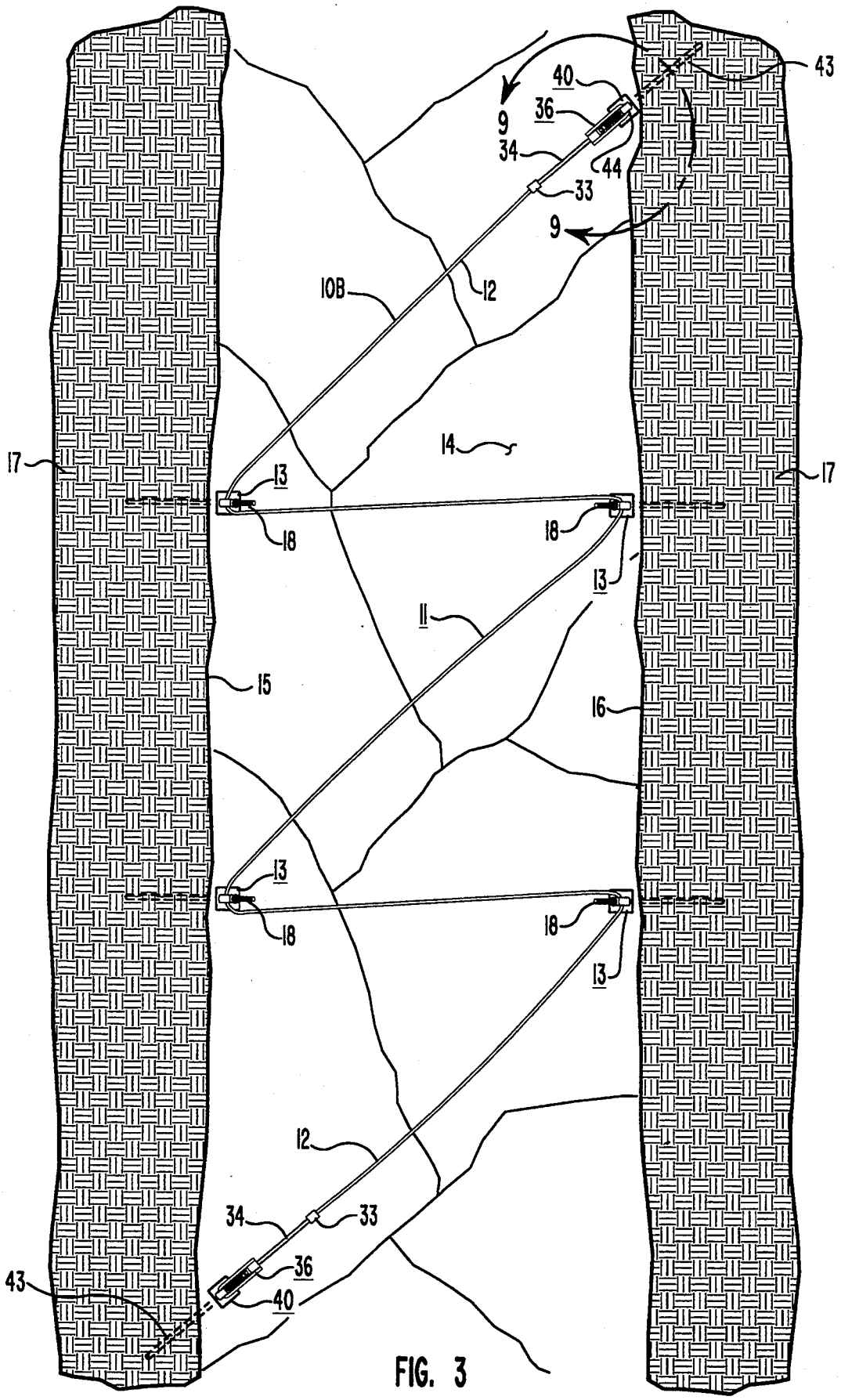
FIG. 3 is similar to FIGS. 1 and 2, but illustrates that serpentine configurement of the cable connector, employed in an essentially plural-Z configurement type of cable system, incorporating end structure for securement and tensioning purposes, which end structure can also be employed at the ends of the cable connectors in FIGS. 1 and 2.
Figure 9:
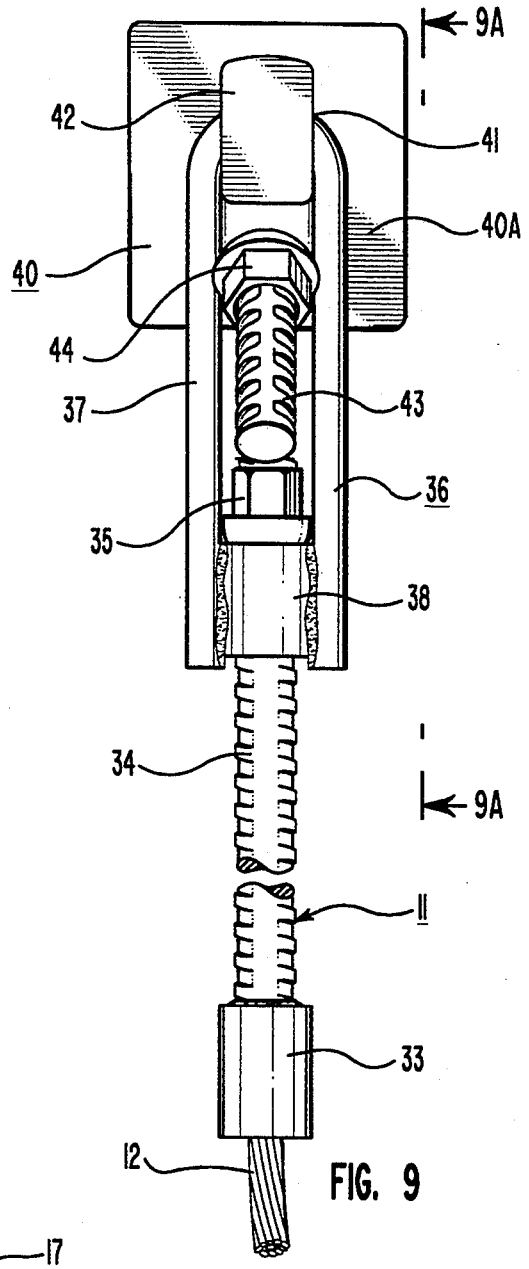

FIG. 9 is an enlarged detail taken along the arcuate line 9—9 in FIG. 3, and is angularly displaced counter-clockwise so as to illustrate the bottom of a horn-type bracket which is used with a stirrup and other structure to secure the cable connector to such bracket; the bracket illustrated may be similar to that shown in the inventor's issued U.S. Pat. No. 5,026,217, the disclosure of which is fully incorporated herein by way of reference.

Figure 9A:
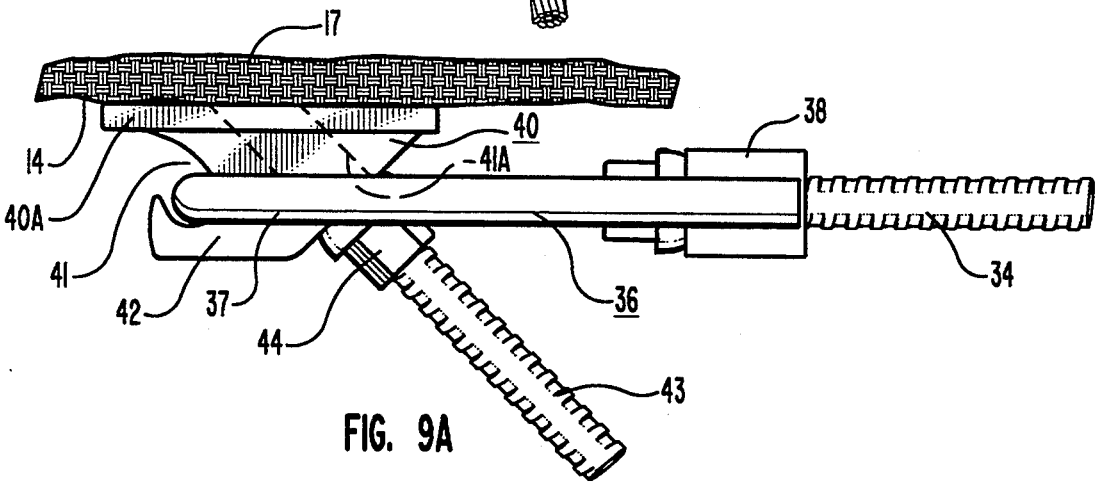

FIG. 9A is a side view of the structure of FIG. 9, and is taken along the line 9A—9A in FIG. 9 and rotated 90 degrees in a counter-clockwise direction.

Figure 10:
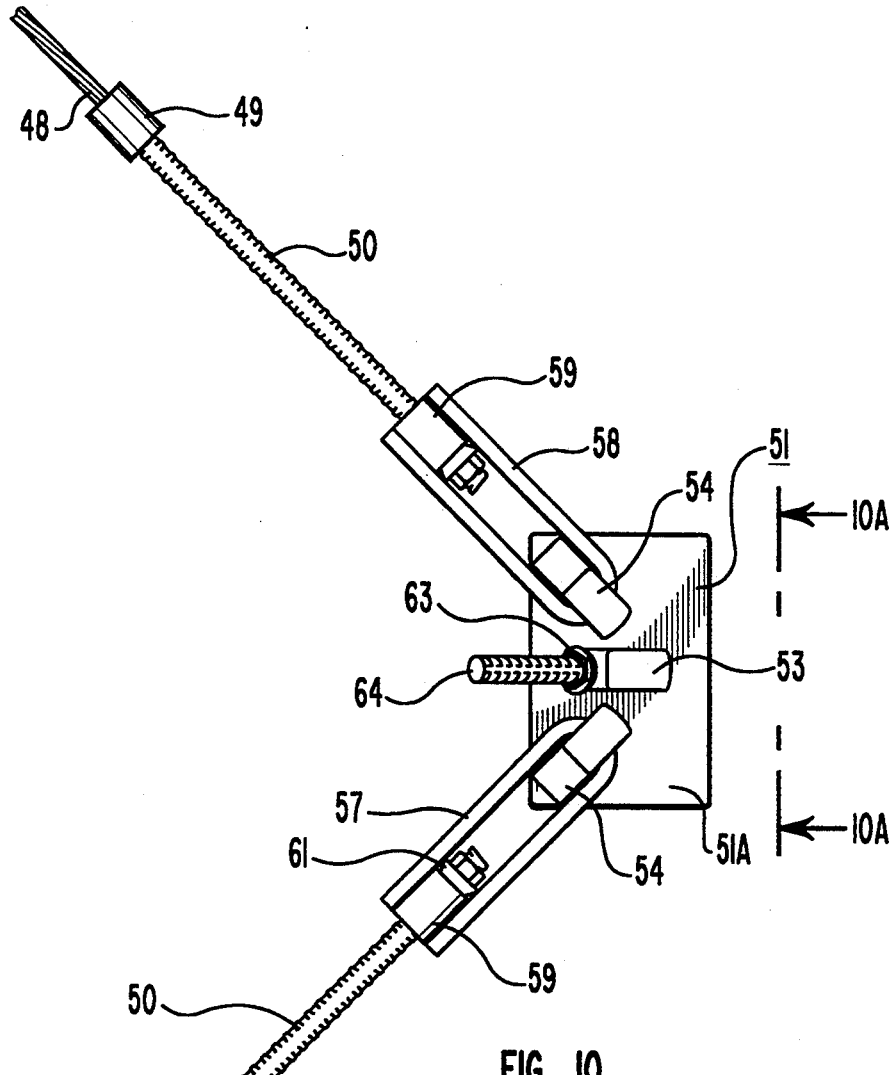

FIG. 10 is a fragmentary enlarged bottom plan, taken along the line 10—10 in FIG. 5, of an alternate bracket employed in the invention wherein take-up structure can be secured thereto and retained thereby in mutually angular configurement.

Figure 10A:
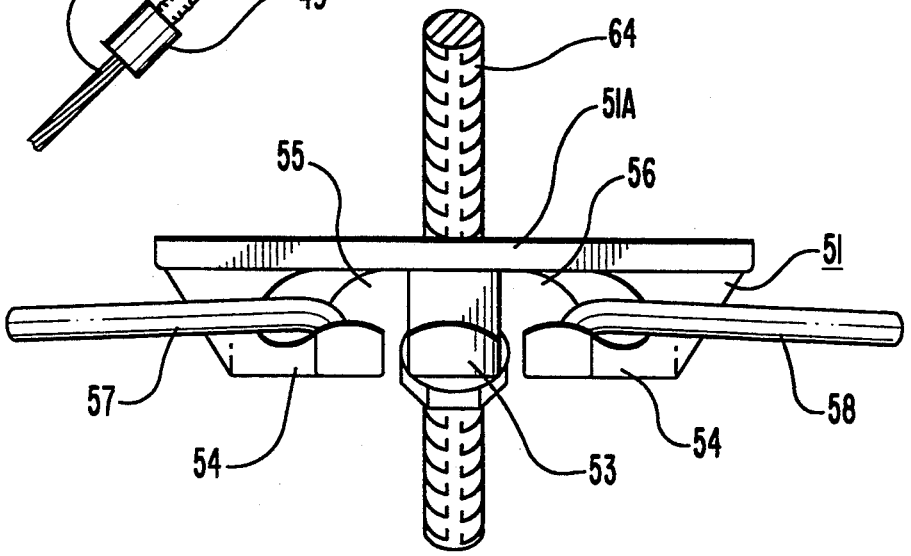

FIG. 10A is a view taken along the line 10A—10A in FIG. 10, rotated 90 degrees in a counter-clockwise direction, to illustrated a forward end view of this structure.

Figure 10B:
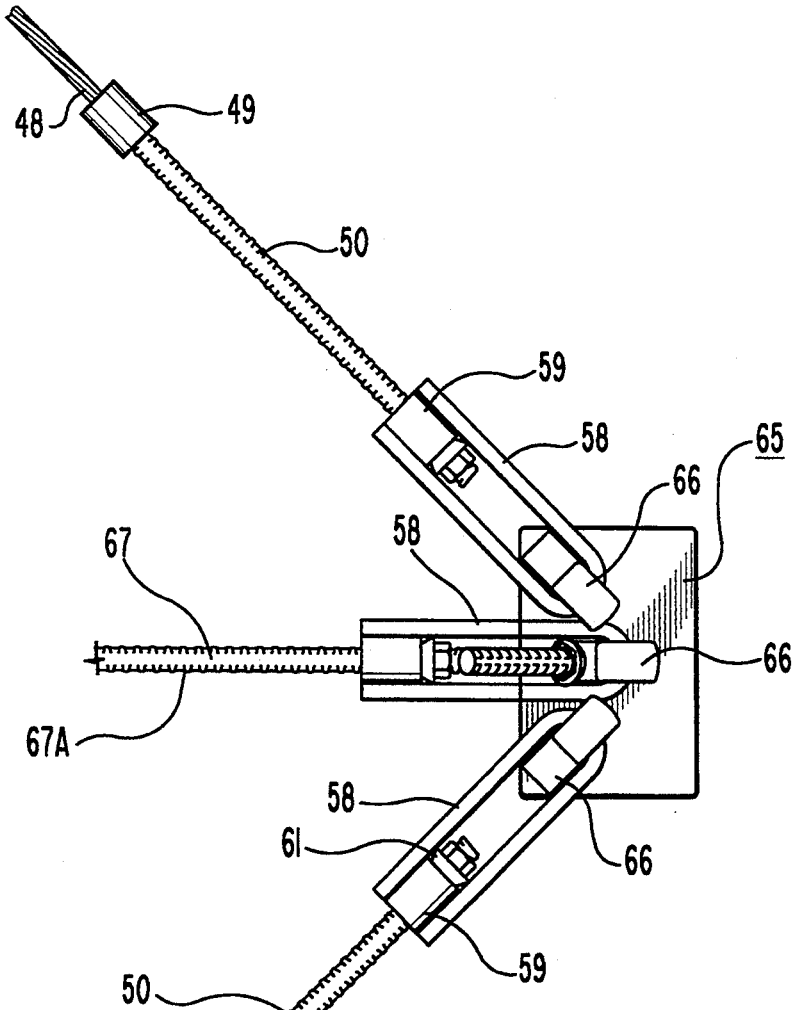

FIG. 10B is an enlarged fragmentary view taken along the arcuate line 10B—10B in FIG. 6.

Figure 10C:
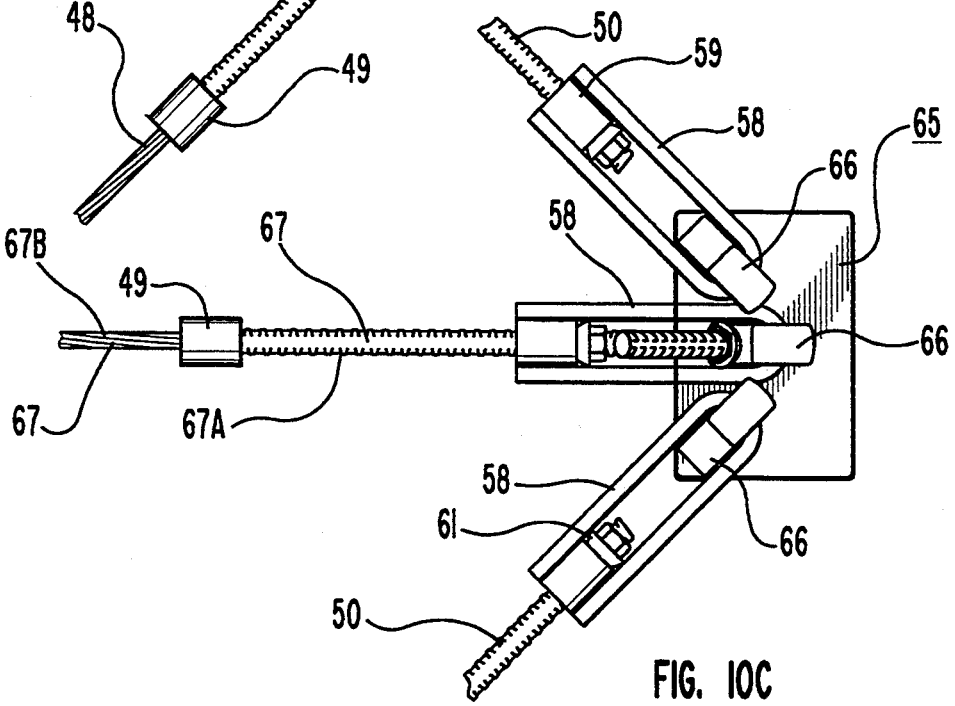

FIG. 10C is similar to FIG. 10B but illustrates an elongate cable connector being utilized in lieu of the tie rod type connector of FIG. 10B.

Figure 11:
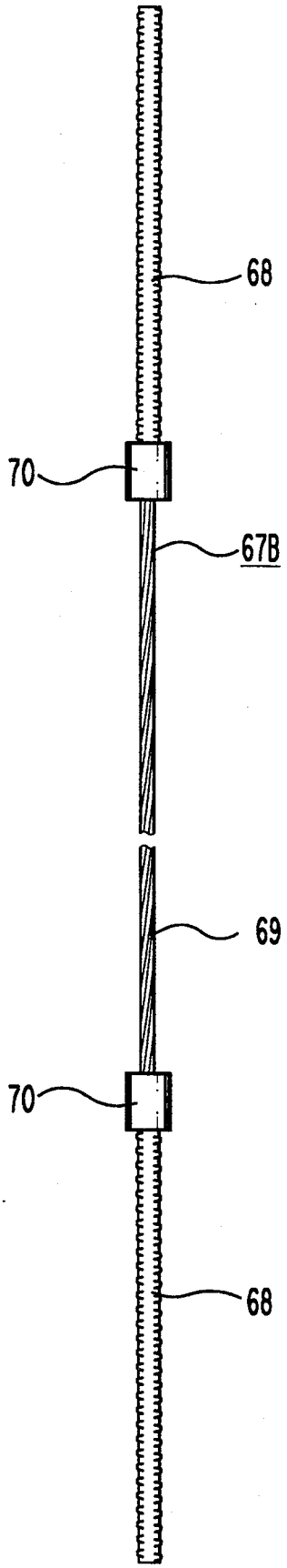

FIG. 11 is a front view, broken away, of an elongate device usable for inter-bracket connections and adaptable for use as an anchor bolt or roof bolt as below described.

Figure 12:
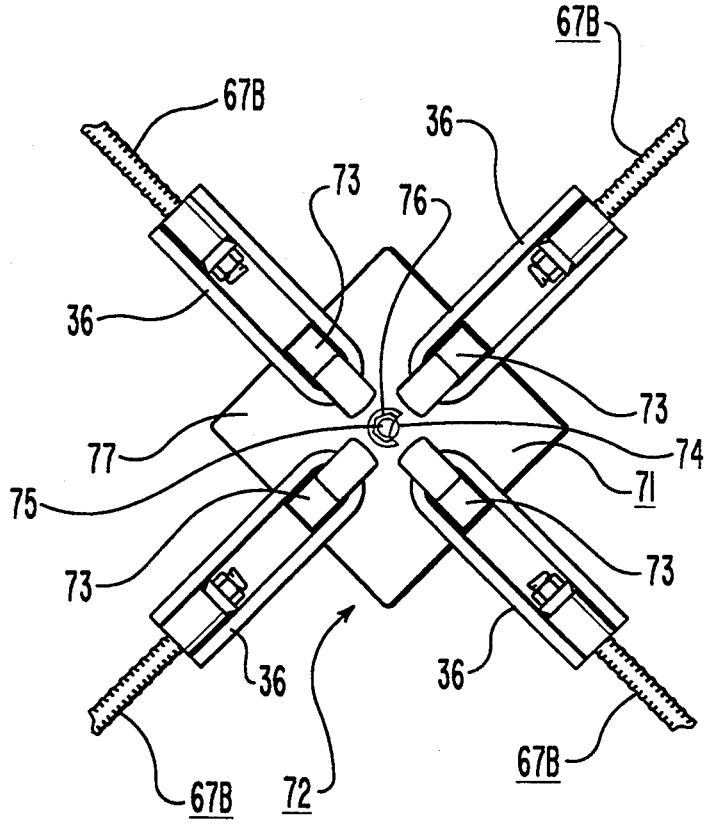

FIG. 12 is an enlarged view taken along the arcuate lines 12—12 in FIG. 6, illustrating a four-way bracket connecting-structure useful for tying elongate support members together, to further aid in the latter's support of roof strata.

DETAILED DESCRIPTION OF PREFERRED EMBODIMENTS

In FIG. 1 mine roof support system 10 includes a cable connector 11 provided with opposite end fittings, not shown in FIG. 1, having a primary cable 12 disposed in serpentine fashion and looped about brackets 13 in the manner indicated. Brackets 13 are secured against roof 14 by anchor bolts 18 proximate the junctures between roof 14 and opposite ribs 15 and 16 of mine strata 17. The anchor bolts 18 will be positioned in place in apertures drilled into the strata and secured in place by an epoxy mix or by other means. The design of the anchor bolts will be conventional, and securement nuts 25, see FIG. 8 but not shown in FIG. 1, are provided to tighten the bearing plates 19of the brackets 13 directly against the mine roof strata surface at 14.

The several brackets 13 in FIG. 1 are illustrated in a preferred design in FIGS. 7 and 8. Bracket 13 includes a bearing plate 19 having an upper bearing surface 20 which bears upon the lower surface 21 of the roof strata at 14. Depending from the bearing plate 19 is a body portion 22 which is integral with the bearing plate. The entire unit comprising the bracket 13 is preferably a unitary cast part. Body portion 22 includes a forward angulated reaction surface 23. The body portion 22 has an angulated aperture 24 which proceeds through the part and through the angulated reaction surface 23. The purpose for the inclusion of the angulated aperture 24 is to receive anchor bolt 18. A nut 25 is provided with an outwarding convex head portion 26 serving to center the nut and hence the anchor bolt relative to aperture 24.

The depending body portion 22 includes an opening 27. Opening 27 includes an upper recess 28, a lower recess 29, and forward recess or cable reaction-surface seat 30, which are contiguous with one another. Opening 27 is sufficiently large at its mouth 31 to receive cable 32 and to allow the same to be emplaced in the forward recess 30. One such cable is so positioned as indicated by the solid lines in FIGS. 7, 8; then, additional cables, generally one cable, see 32A, will be caused to enter into the opening 27 at mouth 31, descend into the lower recess 29 and then, when in tension, the latter is permitted to advance forwardly to further thrust against cable 32. Accordingly, in FIG. 8 additional cables 32A and 32B are shown and illustrated in phantom lines.

The opposite ends of the cable connector 11 in FIG. 1 will include respective junction elements 33, one being shown in FIGS. 9, 9A, to which the cable 12 and shaft 34 are oppositely joined. The shaft will include a tightening or tensioning nut 35 that bears upon the inner surface of cylinder 38. Cylinder 38 forms a portion of U-shaped stirrup 36, the latter principally comprising stirrup member 37. The stub cylinder or bushing 38 will be welded to the opposite ends of the stirrup, and the forward surface of nut 35 will engage the rear surface of cylinder 38, the combination serving to tension shaft 34 and, hence, the entire cable connector 11. Further tightening can be accomplished by identical structure as seen in FIG. 9 which will likewise form a part of the connector 11, being also attached to cable 12 at the bottom of FIG. 1.

U-shaped stirrup 36 will be emplaced in opening 41 of end bracket 40, e.g. a horn-type bracket as shown in the inventor's U.S. Pat. No. 5,026,217, the latter including its own depending portion 42 and bearing plate 40A integral therewith. The end bracket will have an angulated aperture or opening 41A accommodating the placement of an anchor bolt for securement to the roof strata in a manner such that the anchor bolt overlaps the rib plane of the mine opening. Anchor bolts 43 for other brackets 40 will be similarly emplaced and anchored as the anchor bolts 13 in FIG. 1.

Accordingly, the structure seen in FIG. 9 will form a part of the cable connector 11 in FIG. 1 at opposite extremities thereof, this for securing and tightening the cable 12 at its opposite extremities so as to tension the entire truss system 10.

Figure 2:
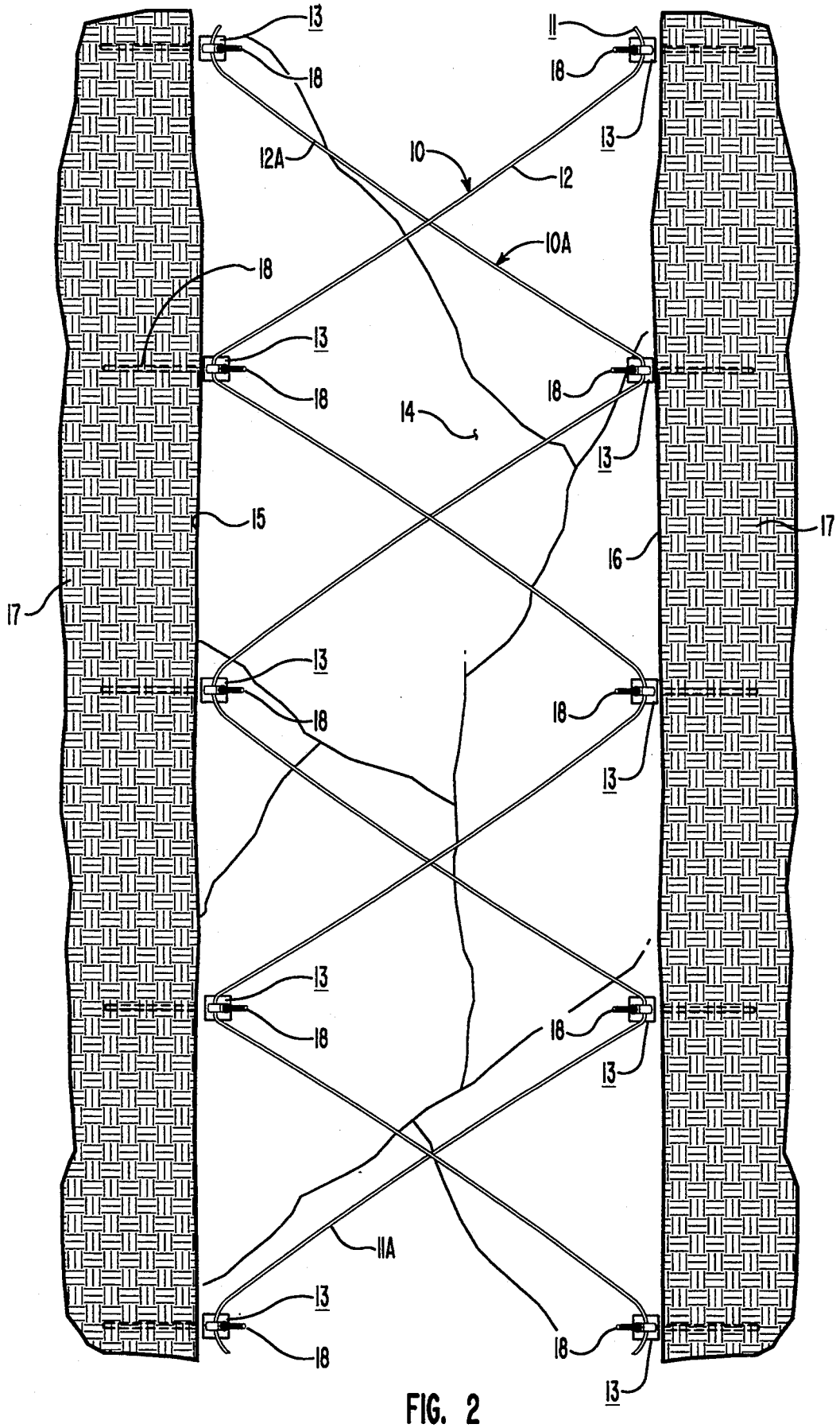
FIG. 2 is similar to FIG. 1, but illustrates a second serpentine configured cable connector being installed with the first, both incorporating installation brackets in the mine roof support system shown.

The truss structure 10A of FIG. 2 is essentially similar to that seen relative to the truss structure 10 in FIG. 1, excepting that in FIG. 2 there are a pair of cables 12 and 12A which respectively proceed in generally serpentine fashion over the roof area of the mine and which are looped about essentially opposed brackets 13 arranged in the pattern indicated in FIG. 2. The cable connectors 11 and 11A, again, will incorporate the opposite end structures a representative one of which is seen in FIG. 9. This will apply to both ends of both cables.

FIG. 3 illustrates a roof support structure 10B that is similar to structure 10 excepting that the brackets 13 are placed opposite each other, being secured again to the mine roof over ribs 15 and 16 by anchor bolts 18 as hereinbefore explained. Thus the cable 12 will proceed in a multiple z-shaped pattern as illustrated and be tightened by the end structures of the cable connector 11. A representative cable end tightening structure is detailed at the upper portion of the drawing and is also amplified upon in FIGS. 9, 9A.

Accordingly, once the brackets 13 are secured in place, then the cable is wrapped about the brackets 13, 22 at their respective openings 27 in FIG. 8 so that the end connection structure in the arcuate line 9—9 in FIG. 3, by way of example, may be utilized, e.g., to tighten the cable 12 at each of its ends.

Figure 4:
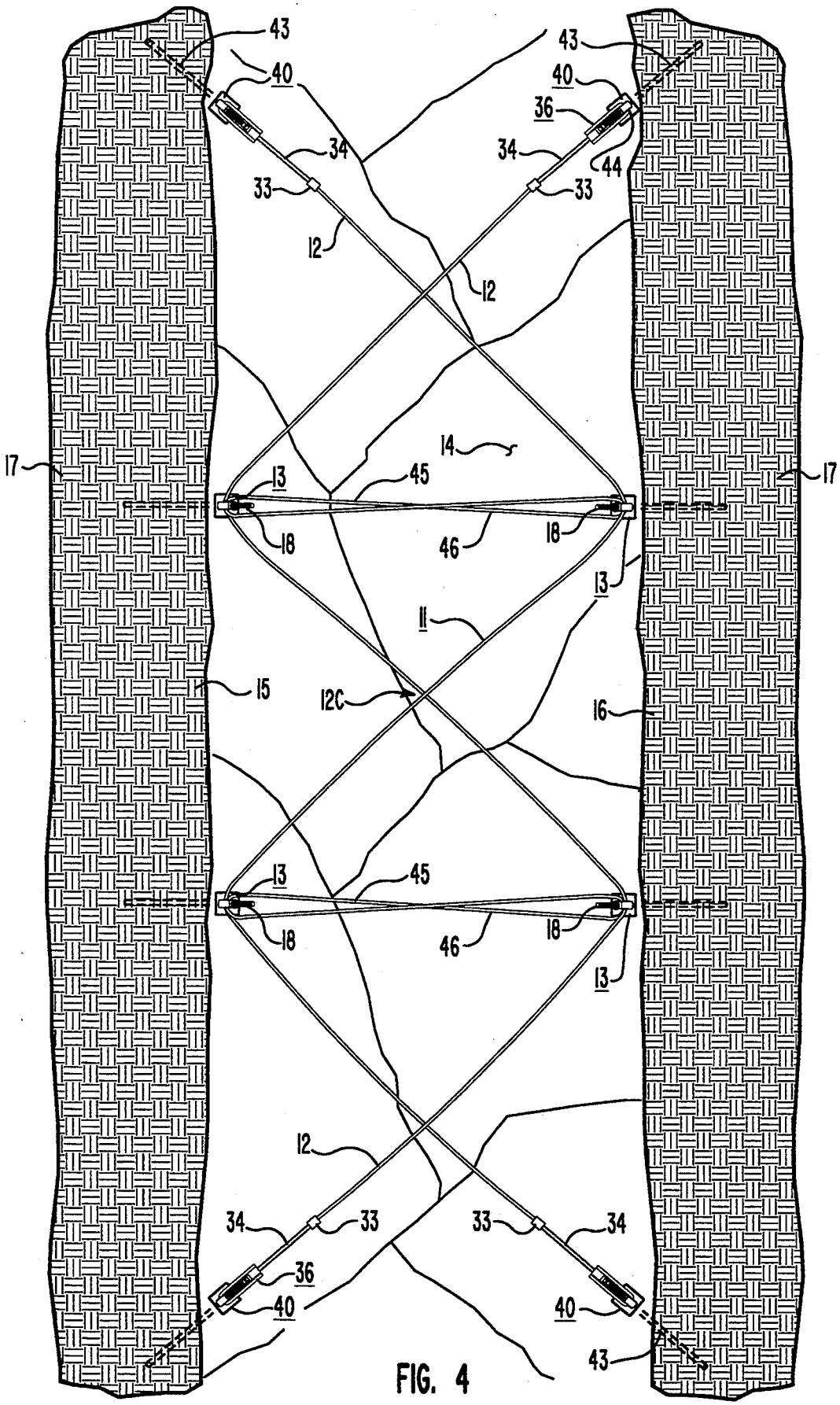
FIG. 4 is a bottom plan similar to FIGS. 1 through 3, but illustrating an additional cable system incorporated with the brackets installed at the mine roof.

The cable support system in FIG. 4 is identified as 12C and, as shown, may include a pair of cables 12 arranged in opposed serpentine configurations looped about the respective brackets 13. Cable portions 45 and 46, by way of example, may comprise medial portions of the respective cables 12 and simply form looping segments or portions which are disposed in the position shown to apply direct tensioning between opposed brackets 13; alternatively, the cable portions 45 and 46 may comprise independent, generally tensioned cable loops. Again, as in the previous configurations, the cables are each provided with the end structures, at opposed ends, which include brackets 40 and anchor bolts 43, see FIGS. 9, 9A.

In FIG. 5 an additional support system 12D is shown. The same includes a series of elongate members 47 each of which is provided elongate portion 48, opposite junction elements 49 and also opposite threaded shafts 50. An angulated two-way bracket 51 is provided at several locations in FIG. 5 and is anchored in place at each location by the customary anchor bolts 52.

The elongated portions 48 as seen in FIG. 5 may comprise tie-rod connectors or, preferably, cable lengths. Brackets 51 are illustrated in representative form in FIGS. 10 and 10A; thus, each respective bracket 51 will include a bearing plate 51A, an angulated transverse base or body portion 53, and respective angulated horn-shaped retainers 54. Each of the retainers or retainer portions 54 includes an opening 55, 56 for receiving and engaging the respective looped ends of stirrups 57 and 58. The stirrups will be supplied stub-cylinders 59 to receive the shafts 50, the latter being tensioned and secured in place by nuts 61.

In assembly, and as will be typical of the remaining mine roof support configurations, brackets are first emplaced by securement to mine roof strata in the manner indicated, with respective nuts 25, 63 being tightened to effect such securement. Subsequently, the cable assembly is made up, with the stirrups thereof being looped over the horn-shaped retainer portions 54. Thereafter the nuts 61 are tightened, as may be elected, so as to cinch up the over-all cable structure. In practice the stirrups will be elongated to a substantial degree, perhaps from 3 to 6 feet, to allow for a sufficient travel path for the threaded shafts 50 upon the take-up of nuts 61, see FIG. 10, to allow for sufficient tensioning of the cable structure. As to FIG. 10 it is seen that retainer portions 54 mutually extend radially outwardly on opposite sides of the depending body portion 53 and are disposed in acute-angle relationship with body portion 53.

Reverting to FIG. 6, this figure illustrates a pair of opposed serpentine structures utilizing the various brackets 51 with the end brackets 40 in the manner as similarly disclosed and previously set forth. Then, the tightening of the nuts on the shafts which are received by the individual stirrups provides the tensioning desired in all of the embodiments as per FIGS. 5 and 6, for example. The shafts of individual cables as per FIGS. 1 and 2, perform, of course, their tensioning function.

It will be noted that where cables are used, then severe undulations in the mine roof surface are accommodated with ease. This is much preferred to tie-rod interconnections between the brackets; albeit, these may be used as the elongate portions described. Anchor bolts 64 will be utilized with the nuts 63 to secure the several brackets 51 to and against the mine roof strata over the mine roof span at 14. Anchor bolts will be primarily fastened in place by the customary epoxy-mix or cement grout methods, etc., well known in the art. The term "horn-configured," as used herein, refers in general to the shape of a customary saddle-horn in the equestrian art.

FIG. 10B illustrates a three-way bracket 65 having integral stirrup retainer elements or retainer horns 66. These secure and retain stirrups 58, see FIG. 10, which themselves receive the threaded end of tie rod or other elongate connector 67. The elongate connector 67, see FIG. 6, may take the form of a tie rod 67A in FIG. 10B; in FIG. 10C, essentially similar to FIG. 10B, the elongate connector 67 takes the form of a cable connector 67B formed of a respective threaded stub shaft 68 at opposite ends, one end being shown, a cable length 69, and respective junction elements 70, see also FIG. 11. As to FIG. 11, this elongate connector can be used at any one of several desired locations; furthermore, with the uppermost junction element 70 and stub shaft 68 either being employed or not employed, the elongate connector 67B can be used as a roof bolt or anchor bolt.

FIGS. 6 and 12 illustrate that a four-way (4W) bracket 71 can be employed at the intersection of elongate connector structure as at 48 and 49. Bracket 71 includes bearing plate 72 and depending horn or ear retainer elements 73. These respectively receive stirrups 36 which are now employed, see FIG. 9, for coupling to the ends of the elongate connectors, i.e. see element 67B in FIG. 11, whatever form such connectors may take. The bearing plate can include a central aperture 74 which receives roof bolt 75, e.g. similar to anchor bolt 18, and a nut 76 securing the end of the roof bolt 75 relative to the lower surface 77 of bearing plate 72 by thrusting engagement with the latter. Referring to FIGS. 6 and 12, interconnection with the four-way brackets 71 can be effectuated by tie rods or their equivalents, see 67, cables, see members 47 and 67B, or a combination of both.

Broadly, a principal method for practicing the invention is to: (a) provide a series of mutually spaced brackets, (b) positioning and anchoring said brackets to mine roof strata to delineate a roof span therebetween, (c) providing elongate support structure for engagement with said brackets, (d) positioning said elongate support structure across said roof span and in engagement with said brackets, and (e) anchoring said support structure to said roof span.

The method can be modified in connection with the structural provisions as enumerated in the drawings, and can also include the additional step of tensioning said elongate support structure, and this whether said support structure includes one or more cable lengths, one or more tie rods or their equivalent, or both tie rods and cables. Interconnections in the form of the provision of stirrup take-up constructions are preferred. Again, the invention is useful both in pre-tensioned cable and/or trussing systems and also also in passive systems wherein the possible downward dialation of the roof surface thrusting against the support structure will produce the tensioning of the support structure and its reactive effect against pronounced additional downward movement of the roof.

While the particular embodiments of the invention have been shown and described, it will be obvious to those skilled in the art that various changes and modifications may be made without departing from the essential aspects of the invention and therefore the aim in the appended claims is to recover all such changes and modifications that fall within the true spirit and scope of the invention. Code: b:truss1

I claim:

1. A support system for supporting a mine roof and including, in combination, a plurality of mutually spaced mine roof brackets provided with respective anchor bolt means for anchoring said mine roof brackets to mine roof strata at opposite sides of a mine roof span, and a cable connector comprising an elongated cable disposed beneath and crossing said span, looping about and mutually securing said mine roof brackets together, and provided with opposite end structural means for securement of said cable connector to said mine roof and also for take-up of said cable connector, whereby to tighten said support system and thereby deter failure of said mine roof strata proximate said span.

2. The support system of claim 1 wherein each of said brackets has a bearing plate for bearing against said mine roof strata and a depending body portion integral with said bearing plate and provided with an angulated aperture receiving said anchor bolt means, respectively, said depending body portion being provided with an opening for receiving said cable.

3. The support system of claim 1 wherein each of said brackets has a bearing plate for bearing against said mine roof strata and a depending body portion integral with said bearing plate and sharing with said bearing plate an angulated aperture receiving said anchor bolt means, respectively, said depending body portion being provided with a cable-admittance opening cavity defining contiguous, cable-receiving recesses.

4. A support system for supporting a mine roof and including, in combination, a plurality of mutually spaced mine roof brackets provided with respective anchor bolt means for anchoring said mine roof brackets to mine roof strata at opposite sides of a mine roof span, and plural cable connectors each comprising an elongated cable disposed beneath and crossing said span, looping about and mutually securing selected ones of said mine roof brackets together, and each provided with opposite end structural means for securement of said cable connectors, respectively, to said mine roof and also for allowing for take-up of said cable, whereby to install said support system in a desired manner.

5. A support system for supporting a mine roof and including, in combination, a plurality of mutually spaced mine roof brackets provided with respective anchor bolt means for anchoring said mine roof brackets to mine roof strata at opposite sides of a mine roof span, said mine roof brackets each having a pair of depending body portions each provided with reaction surface openings; a series of elongate structures each having an elongate member provided with a take-up stirrup, said stirrups being disposed over respective ones of said depending body portions and positioned in said openings, each of said stirrups being provided with means for take-up relative to said elongate members.

6. The support system of claim 5 wherein said elongate member comprises a cable.

7. The support system of claim 5 wherein said elongate structures each comprise an elongate element provided with a threaded shaft at opposite ends, a respective stirrup connector disposed at said opposite ends and respectively having a shaft-receiving end portion receiving said shaft, and a take-up nut disposed within said stirrup connector, threaded upon said shaft, and bearing against said end portion.

8. A mine roof bracket including, in combination, a bearing plate, a central, angulated transverse base depending from and integral with said bearing plate, the combination of said transverse base and said bearing plate being provided with a common angulated aperture for reception of an external anchor to be employed for securement of said bracket to and abutting mine roof strata, and a pair of mutually angularly arranged, depending retainer portions integral with said bearing plate and respectively formed with concave reaction surfaces for receiving respective, external take-up structures to be mounted to and over said bracket at said retainer portions, said retainer portions mutually extending radially outwardly on opposite sides of and in respective acute-angle relationship with said transverse base.

9. The bracket of claim 8 wherein said retainer portions are respectively generally horn-configured.

10. In combination: mine roof bracket comprising a bearing plate having an upper bearing surface for contact and bearing engagement with the exposed roof surface of external mine roof strata defining a mine roof, and a depending body portion integral with and depending from said bearing plate, said depending body portion having an angulated aperture in common with said bearing plate for receiving an external anchor bolt, said depending body portion having a cable insert opening forming plural, cable-receiving recesses communicating with each other, and wherein said cable insert opening forms a cable-admittance mouth of lesser size dimension than the combination of said cable-receiving recesses; and plural cable means disposed in respective ones of said cable-receiving recesses and looped around said depending body portion for tending to support said external mine roof strata.

11. A support system for supporting a mine roof and including, in combination, a plurality of mutually spaced mine roof brackets provided with respective anchor bolt means for anchoring said mine roof brackets to mine roof strata at opposite sides of a mine roof span, and a cable connector comprising an elongated cable disposed beneath and crossing said span, looping about and mutually securing said mine roof brackets together, and provided with opposite end structural means for securement of said cable connector to said mine roof and also for take-up of said cable, whereby to tighten said support system and thereby deter failure of said mine roof strata at said span, said cable connector includes junction elements disposed at opposite ends of said cable, threaded shafts respectively secured to said junction elements, a pair of stirrups respectively disposed over and engaging said brackets, and means for operatively interconnecting said threaded shafts with said stirrups.

12. A support system for supporting a mine roof and including, in combination, first and second, mutually spaced series of brackets including means for affixing said brackets to mine roof strata, the distance between said first and second series defining a mine roof span; elongate cable connecting means disposed underneath and spanning said span, looped around and engaging said brackets, and provided with take-up structure constructed for anchoring to said mine roof strata.

* * * * *